United States Patent [19]

Fujioka

[11] Patent Number: 4,989,567

[45] Date of Patent: Feb. 5, 1991

[54] ENGINE SPEED CONTROLLING SYSTEM IN CONSTRUCTION MACHINE

[75] Inventor: Jun Fujioka, Hiroshima, Japan

[73] Assignee: Kabushiki Kaisha Kobe Seiko Sho, Kobe, Japan

[21] Appl. No.: 381,966

[22] Filed: Jul. 19, 1989

[51] Int. Cl.[5] ..... F02M 39/00

[52] U.S. Cl. ..... 123/385; 123/357; 414/699

[58] Field of Search ..... 123/385, 386, 387, 357, 123/358, 359, 371; 414/699; 60/431

[56] References Cited

U.S. PATENT DOCUMENTS

| | | | |
|---|---|---|---|
| 2,986,291 | 5/1961 | Schick | 123/373 |
| 3,939,738 | 2/1976 | Apey | 123/357 |
| 4,373,850 | 2/1983 | Dorham | 123/386 |
| 4,606,313 | 8/1986 | Izumi | 123/357 |
| 4,638,779 | 1/1987 | Kitada | 123/385 |
| 4,643,146 | 2/1987 | Sprifssler | 123/385 |
| 4,774,921 | 10/1988 | Sakaguchi | 123/385 |
| 4,838,755 | 6/1989 | Johnson | 123/385 |

FOREIGN PATENT DOCUMENTS

| | | | |
|---|---|---|---|
| 0073288 | 3/1983 | European Pat. Off. | 123/385 |
| 0133451 | 8/1983 | Japan | 123/385 |

*Primary Examiner*—Carl Stuart Miller

*Attorney, Agent, or Firm*—Oblon, Spivak, McClelland, Maier & Neustadt

[57] ABSTRACT

In a construction machine having an engine speed setting device, a throttle lever for instructing a set number of revolutions to the engine speed setting device, and plural operating levers each for instructing the operation of an actuator, an engine speed controlling system including a lever neutral detector for detecting a neutral condition of the operating levers and outputting a lever neutral signal. A positive action switch outputs a deceleration command signal when operated by an operator. A control device outputs to the engine speed setting device either a normal operation command at the set number of revolution provided by the throttle lever or a deceleration command at a small number of revolutions in accordance with the signals provided from the lever neutral detector and the switch. The control device is constructed so as to output the deceleration command to the engine speed setting device only when it has received the deceleration command signal from the deceleration command issuing means during issuance of the lever neutral signal from the lever neutral detector and output the normal operation command to the engine speed setting device when the lever neutral signal form the lever neutral detector has been extinguished.

4 Claims, 2 Drawing Sheets

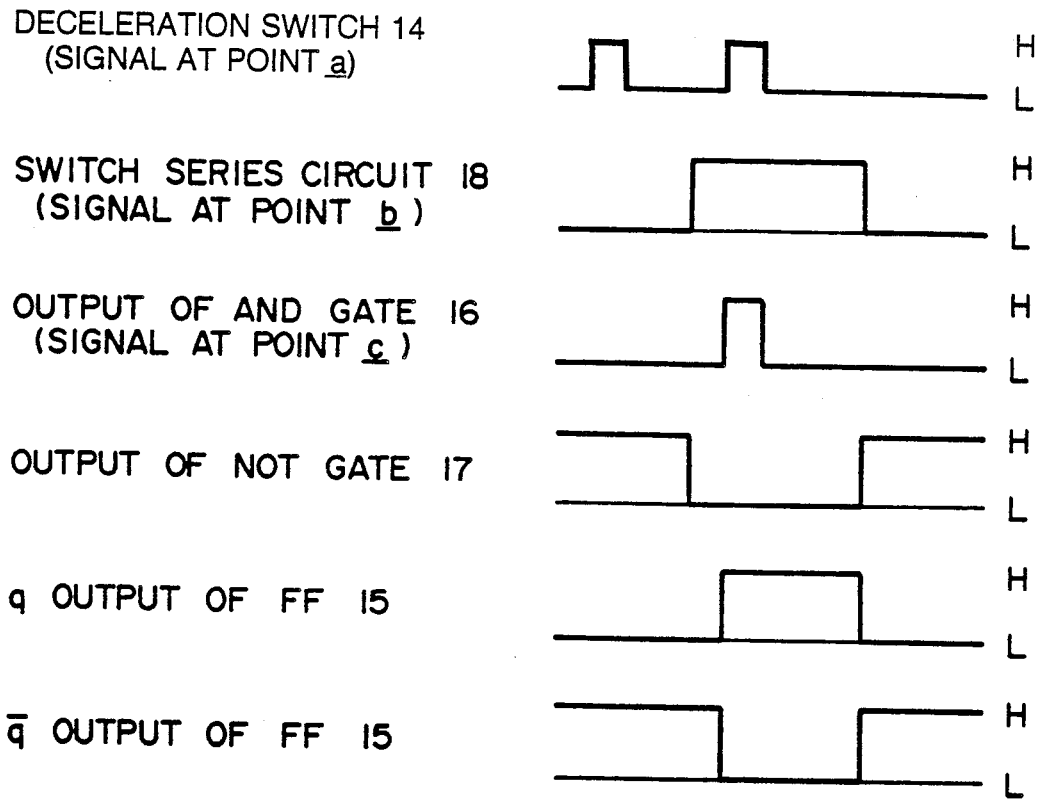
FIG. 4
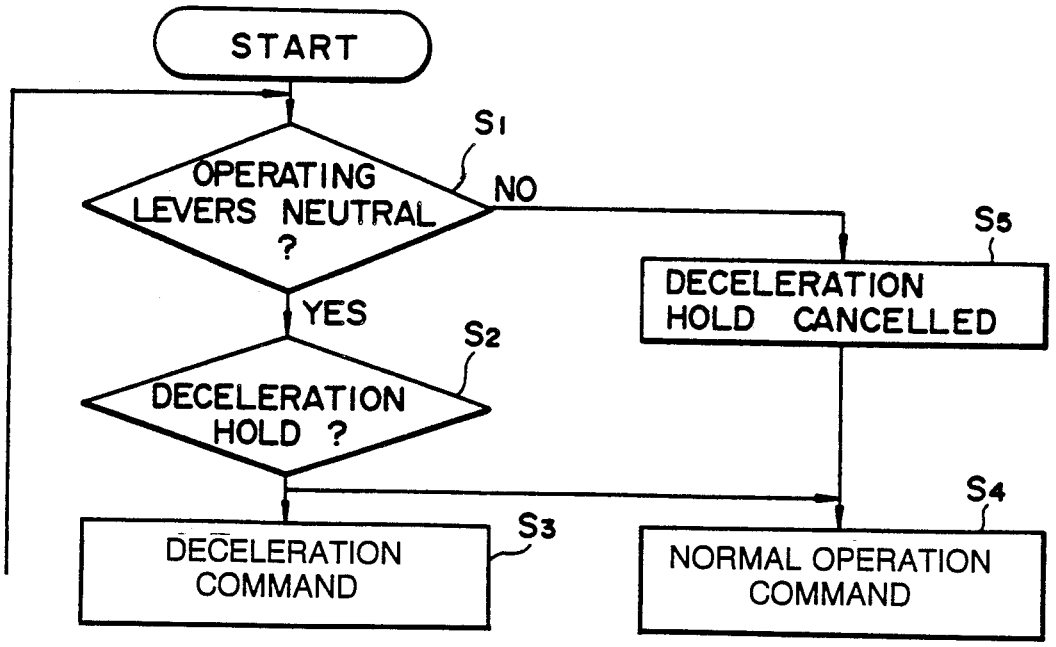

ENGINE SPEED CONTROLLING SYSTEM IN CONSTRUCTION MACHINE

BACKGROUND OF THE INVENTION

1. Field of the Invention

The present invention relates to an engine speed controlling system capable of decreasing the engine speed for fuel economy during suspension of work in a construction machine such as a hydraulic shovel.

2. Description of the Prior Art

As this type of an engine speed controlling system, or a so-called auto-decelerating system, there has heretofore been known such a system as disclosed in Japanese Patent Publication No. 38561/85 wherein when a neutral condition of operating levers has been continued for a preset delay time, this condition is judged to be an operation suspended condition and the engine speed is decreased.

In an actual operation, however, a stand-by condition sometimes continues over the above delay time when a preset engine speed is to be maintained so that the operation can be restarted any time without being stopped. But the foregoing auto-decelerating system functions also in such a case against the operator's will and thus the operability thereof has been poor. The engine consumes a large amount of fuel particularly at the time of sudden rise from low speed, so if the control of slowdown (auto-deceleration) to acceleration against the operator's intention of continuing the work is repeated, the amount of fuel consumed will rather increase contrary to the desired purpose of fuel economy.

In order to eliminate such drawback there has been proposed such a system as disclosed in Japanese Patent Laid-Open No. 1837/86 wherein a grip sensor is attached to an operating lever to prevent the auto-decelerating function from being exhibited as long as the operator touches the operating lever even when the lever is in a neutral condition (in other words, to allow such function to be exhibited only when the operator releases his hand from the lever). However, whether the operator touches the operating lever or not is not always based on the his will. The operator may touch the lever or release his hand from the lever unconsciously, or any other person than the operator may touch the lever. Thus, the conventional system in question is disadvantageous in that the control is not always made exactly according to the operator's will.

SUMMARY OF THE INVENTION

It is therefore the object of the present invention to provide an engine speed controlling system in a construction machine capable of making control which reflects the operator's will exactly.

In a construction machine having an engine speed setting device, a throttle lever for instructing a set number of revolutions to the engine speed setting device, and a plurality of operating levers each for instructing the operation of an actuator, an engine speed controlling system according to the present invention includes lever neutral detecting means for detecting a neutral condition of the said operating levers and outputting a lever neutral signal deceleration command issuing means which outputs a deceleration command signal when operated by an operator, and control means which outputs to the engine speed setting device either a normal operation command at the set number of revolutions provided by the throttle lever or a deceleration command at a small number of revolutions in accordance with the signals provided from the lever neutral detecting means and the deceleration command issuing means, the said control means being constructed so as to output the deceleration command to the engine speed setting device only when it has received the deceleration command signal from the deceleration command issuing means during issuance of the lever neutral signal from the lever neutral detecting means and output the normal operation command to the engine speed setting device when the lever neutral signal from the lever neutral detecting means has been extinguished.

Under the above construction, without a positive operator's intention of operating the deceleration command issuing means, the auto-decelerating function will not be exhibited, and the return to the normal operation is performed automatically by the operation of an operating lever. That is, the operator's will is reflected exactly in both the auto-deceleration and the return to normal operation.

BRIEF DESCRIPTION OF THE DRAWINGS

FIG. 3 is a time chart thereof; and FIG. 4 is a flow chart thereof.

DESCRIPTION OF THE PREFERRED EMBODIMENT

An embodiment of the present invention will be described hereinunder with reference to the drawings.

Figure 1:
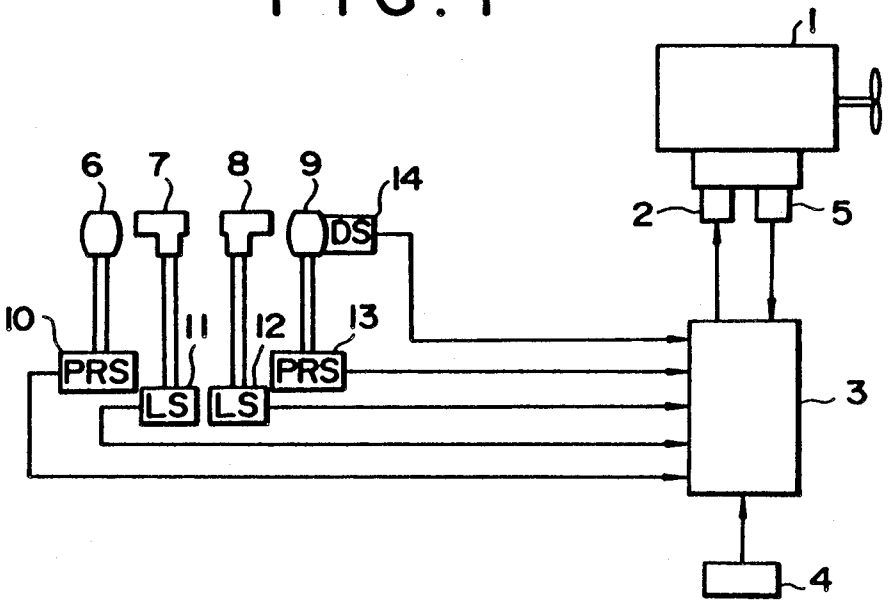
FIG. 1 is a block diagram of an engine speed controlling system according to an embodiment of the present invention.

In FIG. 1, the reference numeral 1 denotes an engine; the numeral 2 denotes an engine speed setting device which comprises a governor for setting the number of revolutions of the engine 1 and a governor driving means (not shown); and the numeral 3 denotes a controller which issues to the engine speed setting device 2 a normal operation command at the number of revolutions set by a throttle lever 4 or a deceleration command (auto-deceleration command) at a small number of revolutions. The engine speed is set in accordance with such command. Numeral 5 denotes an engine speed sensor for detecting the engine speed, whose output is received by the controller 3, which in turn performs a feedback control.

Numerals 6, 7, 8 and 9 denote operating levers, which are of the construction in a hydraulic shovel as an example. From the left-hand side in FIG. 1, the first operating lever 6 is for the rotation arm; the second and third operating levers 7, 8 are for traveling left and right; and the fourth lever 9 is for a boom and a bucket. The first and fourth operating levers 6, 9 are remote control type hydraulic levers, and the second and third levers 7, 8 are mechanical levers. As means for detecting a neutral condition of the levers 6–9 there are provided pressure switches 10 and 13 for the first and fourth levers 6, 9 and limit switches 11, 12 for the second and third operating levers 7, 8 in conformity with the operating methods of those levers. Signals from these switches (hereinafter referred to as the "lever neutral detecting switches") are fed to the controller 3, and when all the switches 10–13 have detected a lever neutral condition, a lever neutral signal is inputted to the controller 3.

On the other hand, a deceleration switch 14 serving as the deceleration command issuing means operated by the operator is attached to the fourth operating lever 9. Unlike the switch used in the foregoing conventional system which switch turns ON or OFF upon touch or release of the operator's hand with respect to an operating lever, not always related to the operator's will, the deceleration switch 14 is a switch which does not operate unless the operator operates it with a positive action, such as, for example, a push-button switch, a tumbler switch, or a snap switch.

Figure 2:
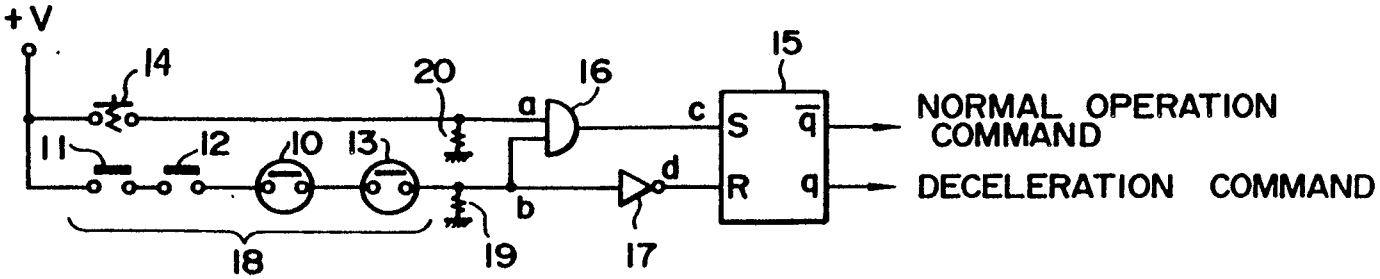
FIG. 2 is a configuration diagram of a control circuit used therein.

Referring now to FIG. 2, there is illustrated the construction of a control circuit which includes the deceleration switch 14 and the lever neutral detecting switches 10–13. In FIG. 2, the numeral 15 denotes a flip-flop circuit (hereinafter referred to simply as "FF"); numeral 16 denotes an AND gate; and numeral 17 denotes a NOT gate. These components are incorporated in the controller 3 shown in FIG. 1. The lever neutral detecting switches 10–13 are connected in series to constitute a switch series circuit 18, which is connected to an input terminal of the NOT gate 17 and also to one input terminal of the AND gate 16. The deceleration switch 14 is connected to the other input terminal of the AND gate 16, and an output terminal of the AND gate 16 is connected to a Set input terminal S of the FF 15, while an output terminal of the NOT gate 17 is connected to a Reset input terminal R of the FF 15. Numerals 19 and 20 each denote a resistor.

The operation of the control circuit having the above construction will be described below with reference to the time chart of FIG. 3.

During operation, that is when at least one of the operating levers 6–9 is in operation, a lever neutral signal is not outputted from the switch series circuit 18 shown in FIG. 2. More particularly, a signal at point b on the output side of the series switch circuit becomes Low in level, so the level of an output signal (signal at point c) from the AND gate 16 becomes Low even if the operator does not operate the deceleration switch 14 (irrespective of whether the level of a signal at point a on the output side of the deceleration switch is High or Low). Thus, since there is no Set input in the FF 15, a High signal is provided from an output terminal $\bar{q}$ of the FF 15, that is, a normal operation command at the number of revolutions set by the throttle lever 4 is provided from the controller 3 to the engine speed setting device 2 both shown in FIG. 1.

On the other hand, even when all the operating levers 6–9 are in a neutral condition and a lever neutral signal is outputted from the switch series circuit 18 (when the level of the signal at point b is High), the signal at point c remains to be Low unless the deceleration switch 14 is turned ON, so that the FF 15 is not inverted and the normal operation command is still provided to the engine speed setting device 2.

Next, when the operator turns ON the deceleration switch 14 with the intention of suspending the work (auto-deceleration) in a neutrally held condition of all the operating levers 6–9 and in a continuously outputted condition of the lever neutral signal from the switch series circuit 18, the output of the AND gate 16 goes High, while at this time the output of the NOT gate 17 is Low, so the FF 15 is inverted by inputting of the High-level signal at point c to the Set terminal S and a deceleration command is provided from an output terminal q of the FF 15 to the engine speed setting device 2, whereby the engine speed is set to a small number of revolutions for fuel economy. Once the decelerating operation is started in this way, the input (signal at point d) of the Reset terminal R of the FF 15 remains Low in level unless an operating lever is operated even with the deceleration switch 14 turned OFF, so that the decelerating operation is continued (deceleration-held condition).

When at least one of the operating levers 6–9 is operated in such deceleration-held condition to restart the work, the level of the signal at point b becomes Low, that of the Set input of the FF 15 becomes Low and that of the Reset input thereof High, so that the deceleration command from the output terminal q is extinguished and instead a normal operation command is provided from the output terminal $\bar{q}$ to the engine speed setting device 2. Thus, at the time of restarting of the work, the engine speed automatically reverts to the number of revolutions set by the throttle lever 4.

FIG. 4 is a flow chart showing the above operations. After start of the engine operation, first in step $S_1$, whether all the operating levers are in the respective neutral positions or not is judged on the basis of the signals provided from the lever neutral detecting switches 10–13. If the answer is affirmative (all the levers are neutral), then in step $S_2$, judgment is made as to whether the operation is in the deceleration-held condition based on turning ON of the deceleration switch 14. If the answer is affirmative, a deceleration command is issued to the engine speed setting device 2 (step $S_3$), while if the answer is negative, normal operation command is issued to the setting device 2 (step $S_4$). On the other hand, in case of a negative answer (the levers are not neutral) in step $S_1$. The deceleration-held condition is cancelled in step $S_5$ and a normal operation command is issued in step $S_4$.

Although in the above embodiment there are used FF 15, AND gate 16 and NOT gate 17 as means for changing over commands (normal operation and deceleration) from one to the other for the engine speed setting device 2 on the basis of the operation of the lever detecting switches 10–13 and that of the deceleration switch 14, this change-over may be performed by a software processing using a microcomputer. Further, the deceleration switch (deceleration command issuing means) may be disposed in a position where the operating levers are not located, or it may be a pedal type or a voice input type, not the manual operation type.

Thus, according to the construction of the present invention described above, a deceleration command is issued only when the deceleration command issuing means is operated by the operator (when the operator's intention of auto-deceleration is exhibited positively) in a neutral condition of the operating levers, and the reversion to the normal operating is performed by the operation of an operating lever. Such a construction can eliminate the drawback of the prior art wherein the is judged to be stopped and a deceleration command is issued when a neutral condition of the operating levers have been continued for a certain time or upon release of the operator's hand from an operating lever, resulting in exertion of the auto-decelaration function against the operator's will or reversion to the normal operation. In other words, it is possible to effect an engine speed control which reflects the operator's will exactly, whereby the operability is improved and the desired object of the control system, that is, the economization of fuel, can be attained to a satisfactory extent.

What is claimed is:

1. In a construction machine having an engine speed setting device, a throttle lever for instructing a set number of revolutions to said engine speed setting device, a plurality of actuators and a plurality of operation levers each for instructing the operation of a respective actuator, an engine speed controlling system including:

lever neutral detecting means for detecting a neutral condition of said operating levers and outputting a lever neutral signal when all of said operating levers are in a neutral condition;

deceleration command issuing means for outputting a deceleration command signal when operated by an operator; and control means for outputting to said engine speed setting device one of a normal operation command at the set number of revolutions provided by said throttle lever and a deceleration command at a small number of revolutions in accordance with the signals provided from said lever neutral detecting means and said deceleration command issuing means, said control means comprising means for outputting the deceleration command to said engine speed setting device only when said control means has received the deceleration command signal from said deceleration command issuing means during issuance of the lever neutral signal from said lever neutral detecting means, said control means further comprising means for outputting the normal operation command to said engine speed setting device when the lever neutral signal from said lever neutral detecting means has been extinguished.

2. The construction machine of claim 1, wherein said deceleration command issuing means comprises a positive action switch.

3. The construction machine of claim 1, wherein said control means comprises:

a flip flop circuit having Set and Reset inputs and having an output connected to said engine speed setting device;

an AND gate having an output connected to said Set input and having inputs connected to said lever neutral detecting means and said deceleration command issuing means; and a NOT gate having an input connected to said lever neutral detecting means and output connected to said Reset input, whereby said flip flop circuit is inverted when signals from both said AND gate and said NOT gate are high.

4. The construction machine of claim 2, wherein said control means comprises:

a flip flop circuit having Set and Reset inputs and having an output connected to said engine speed setting device;

an AND gate having an input connected to said Set input and having inputs connected to said lever neutral detecting means and said positive action switch; and a NOT gate having an input connected to said lever neutral detecting means and output connected to said Reset input, whereby said flip flop circuit is inverted when signals from both said AND gate and said NOT gate are high.

* * * * *